United States Patent [19]

Ohls et al.

[11] 4,124,942

[45] Nov. 14, 1978

[54] METHOD AND APPARATUS FOR CONTROLLING THE MOISTURE CONTENT OF A WEB OF SHEET MATERIAL

[75] Inventors: Per-Erik Ohls, 42220 Kaipola, Finland; Mauri Soininen, Naantali, Finland

[73] Assignees: Valmet Oy; Per-Erik Ohls, both of Finland; part interest to each

[21] Appl. No.: 674,908

[22] Filed: Apr. 8, 1976

[30] Foreign Application Priority Data

Apr. 9, 1975 [FI] Finland ..... 751075
Jan. 23, 1976 [FI] Finland ..... 760162

[51] Int. Cl.[2] ..... F26B 13/16

[52] U.S. Cl. ..... 34/115; 34/155; 34/159; 34/242

[58] Field of Search ..... 34/115, 155, 159, 242; 68/5 D, 5 E, 20

[56] References Cited

U.S. PATENT DOCUMENTS

| | | | |
|---|---|---|---|
| 2,950,540 | 8/1960 | Fleissner | 34/115 |
| 3,011,266 | 12/1961 | Fleissner | 34/115 |
| 3,048,992 | 8/1962 | Nakaguchi | 34/242 |
| 3,406,462 | 10/1968 | Fleissner | 34/115 |
| 3,445,947 | 5/1969 | Fleissner | 34/115 |
| 3,545,363 | 12/1970 | Bricher et al. | 34/242 |

*Primary Examiner*—John J. Camby
*Assistant Examiner*—Larry I. Schwartz
*Attorney, Agent, or Firm*—Steinberg & Blake

[57] ABSTRACT

A method and apparatus for providing in a web of sheet material, particularly a paper web, a predetermined moisture content which is uniform throughout the web. The web which has been dried so as to be within the hygroscopic range is directed through an enclosure which is closed off from the outer atmosphere while lapping in the enclosure a perfusion roll having a foraminous wall through which a treating gas, such as air of a given humidity or steam with predetermind properties, can pass into the interior of the roll after first passing through the web which laps the roll. By way of a suitable gas-circulating structure, the treating gas is circulated so as to travel out of the interior of the perfusion roll along a given path bath to the web at the exterior of the perfusion roll to pass again through the web and into the perfusion roll, this gas-circulating structure providing the treating gas with predetermined properties for achieving in the web a desired moisture content which is uniform throughout the web.

11 Claims, 8 Drawing Figures

METHOD AND APPARATUS FOR CONTROLLING THE MOISTURE CONTENT OF A WEB OF SHEET MATERIAL

BACKGROUND OF THE INVENTION

The present invention relates to a method and apparatus for achieving a desired moisture content uniformly throughout a web of sheet material, particularly a paper web which has been dried so as to be within the hygroscopic range. As is well known, during the manufacture of sheet material such as paper, this sheet material is invariably dried so as to be within the hygroscopic range. The vapor pressure of the water which is bound in the web is lower than that of free water at the same temperature. The lower the moisture content of the web, the greater the difference between the vapor pressure of the water bound therein and the vapor pressure of free water at the same temperature. Thus, the partial pressure of the water in the paper at a given temperature is lowered as the web becomes drier.

It is particularly to be noted that the vapor pressure of hygroscopic water is the same as the pressure of air at a temperature in excess of 100° C., the latter temperature being higher as the web becomes drier. It is thus to be understood that in principle the web is also in equilibrium with water vapor under atmospheric pressure and superheated to the extent of a relatively small number of degrees Centrigrade. The above physical circumstances constitute the starting point of the present invention.

As is well known, during the manufacture of sheet material such as paper, the latter sheet material is directed over a plurality of cylinders during drying of the sheet material. One of the recognized problems in connection with achieving a paper of high quality is the difficulty of obtaining uniform ultimate moisture content in the web, particularly over the entire width of the web. This difficulty arises from the fact that a multiple-cylinder drying apparatus cannot be constructed and operated in such a way that the drying conditions will be uniform over the entire width of the web which is dried, so as to be capable of achieving a constant specific drying over the entire working breadth of the web. Even in the case where the moisture content and base weight of the web which arrives at the drier from the presses are uniform, the moisture profile of the web in the drying section will lack uniformity for a number of reasons as set forth below.

In the first place, the non-uniformity of the drying atmosphere will result in a lack of uniform drying of the web. This lack of uniformity in the drying atmosphere results from the unavoidable presence of spaces, resembling compartments or pockets, which are defined by the cylinders, rolls, the drying felt or wire, and by the web itself, which is to be dried, with these spaces having a poor ventilation. In the absence of separate ventilation means, air flow in these confined spaces is induced only by the moving surfaces, under the effect of pumping caused by natural water and possibly by the wires which are permeable to air. The air is usually humid in the central region of the paper machine, and this latter circumstance tends to reduce the specific drying at this central region. The greater the width of the paper machine, the greater are the above problems.

In the second place, the margins of the web of sheet material tend to dry to a greater extent than the sheet material between the margins thereof, because the parts of the drying cylinders which engage the margins of the web and extend outwardly beyond them increase the heating surface available for drying the marginal portions of the web.

In the third place, it is difficult to control the conditions inside the drying cylinders. For example, the presence of condensate draining members results in differences in the thickness of the condensate layer and accumulation of uncondensed gases at certain parts of the drying cylinders. The result is unequal heat transfer to the wall of each drying cylinder, and of course non-uniform drying is unavoidable.

The most common expedient utilized for reducing drying problems, in the present state of the art, is to provide the drying apparatus with various types of devices relating to air technology. In part these devices serve only the purpose of equalizing the state of the drying air by increasing the drying air flow in the direction transverse to the direction of travel of the web through the machine, by utilizing various air-blowing nozzles from which the air is blown into spaces transversely with respect to the direction of web travel, these nozzles in addition inducing secondary air flow from the spaces which are situated beside the machine.

It is also known in the art to utilize, for example, so-called doctor blowing devices, and, in machines which utilize drying wires, so-called pocket ventilating devices, by means of which it is attempted to achieve not only a uniform state for the drying air but, in contrast, differences in the state of the drying air in order to produce local differences of specific drying. Thus, the prior art devices may in this latter connection be considered as being utilized to produce intentional errors in the form of unequal local specific evaporation, but means of which actual errors resulting from other factors can be compensated. However, the effect of these prior art devices are limited, particularly inasmuch as truly significant differences of drying conditions in the state of the drying air are difficult to achieve and in addition the effect is smaller as the area of the web where the correction is applied becomes narrower. This latter factor results because turbulence prevents obtaining major differences in the state of the air at relatively narrow zones of the web.

As is known, it has been attempted to achieve equalization of the moisture profile of the web by utilizing devices in the interior of the drying cylinders. Such devices include, for example, profile-correction cylinders which are heated by electrical resistances having a heating power which is arranged so as to be adjustable in blocks which are distributed transversely with respect to the direction of web travel. In fact, it has even been suggested to utilize ceramic insulation which is placed close to the ends of the cylinder and inside the cylinder so as to attempt to reduce the detrimental excessive drying of the web at the margins thereof.

It is also in the art to condition the paper web by passing the latter, after it has been dried, through a treating machine therein the web remains in an accurately controlled atmosphere for a time long enough to achieve throughout the web at least an approximate equilibrium condition with respect to the atmosphere in which the web is located, so that in this way the ultimate moisture content of the web will have a uniformity which is greater as the interval during which the web remains in a controlled atmosphere becomes greater. However, when utilizing high-speed paper machines, such treatment becomes impractical because the treating machine must be made undesirably large and involves an undesirably high cost. The equilibrium referred to above is the state in which the vapor pressure of the water in the web is the same as that of the air which contacts the web.

SUMMARY OF THE INVENTION

It is accordingly a primary object of the present invention to provide a method and apparatus which will to a very great extent avoid the above problems.

In particular, it is an object of the present invention to provide a method and apparatus according to which it becomes possible to achieve a web of sheet material having uniform moisture content througout while at the same time treating the web as it travels at a relatively high speed, so that it becomes possible to utilize the method and apparatus of the invention with high-speed machines.

Also, it is an object of the present invention to provide a method and apparatus according to which not only are portions of the web which have a moisture greater than a desired moisture dried so as to approach the desired moisture but also portions of the web which have a moisture less than the desired moisture gain moisture so as to approach the desired moisture content.

In addition, it is an object of the present invention to provide a method and apparatus according to which it becomes possible to achieve the desired results by utilizing for the treatment of the web commonly available inexpensive treating gases such as air of a given humidity or steam having predetermined characteristics.

It is also an object of the present invention to provide a method and apparatus which are relatively inexpensive as well as highly reliable in operation.

In connection with the apparatus, it is an object of the invention to provide an apparatus which while capable of achieving the above objects at the same time can be of an extremely compact construction so that there is no problem in connection with accommodating the apparatus of the invention at a machine such as a paper machine.

A particular object of the present invention is to provide a method and apparatus according to which it becomes possible to treat an extremely short length of the web in an extremely short time.

A further object of the invention is to provide a method and apparatus which operate with a highly economical utilization of energy in that excessive heating or excessive cooling are not required and relatively low energy consumption can be achieved in connection with operations such as transporting the web and the treating gas.

In order to achieve the objects of the invention, the method of the invention involves passing the treating gas directly through the thickness of the web which is to be treated, with the state of the treating gas having been adjusted to an equilibrium state which is substantially consistent with the desired ultimate moisture content of the web, particularly at the final stage of the treatment thereof, so that in this way parts of the web which have a moisture content greater than the average desired moisture content will become drier while those parts of the web which are drier than the desired average moisture content will gain in moisture so as to approach the state of the treating gas by passing the latter through the web.

With the apparatus of the invention there are one or more rotary profusion rolls each having a foraminous cyliner wall through which the treating gas can pass with each profusion roll surrounded by and situated within an enclosure means defining between itself and the profusion roll a space from which the treating gas can be passed through the web into the interior of the profusion roll to be withdrawn out of the latter by a gas-circulating means which provides the gas with the required properties before the gas is returned to pass again into the interior of a profusion roll subsequent to passing through a web which laps the profusion roll. The enclosure means has an inlet means through which the web is introduced into the enclosure means in a fluid-tight manner, with this enclosure means itself being closed off from the outer atmosphere, and the enclosure means also has an outlet means connected thereto for discharging the web from an exit region of the enclosure means in a fluid-tight manner. Each of the inlet and outlet means includes a pair of rotary sealing rolls or the equivalent thereof, between which the web to be treated can be conducted, so that by way of such sealing rolls it is possible to transport the web to and from the profusion roll. The treatment of the web with a treating gas in the form of steam, according to the present invention, is not necessarily provided only for the purpose of equalizing the moisture profile, although the treatment according to the invention can be put into practice so that the web is dried in a conventional manner up to the desired average dryness and then subsequently the moisture profile is corrected by passing through the web superheated steam at atmospheric pressure and at a predetermined temperature. In this latter operation water is transferred from the excessively moist parts of the web to the excessively dry parts thereof by utilizing the circulating steam flow. With such a method, heating requirements are minimal, with heat being required only to make up the heat losses and leakage and to raise the temperature of the web.

The method of the invention also may be carried out in such a way that the treatment of the web is started with the web having an average moisture content greater than the desired ultimate moisture content. Thus, the method and apparatus of the invention may also be utilized, not only to equalize the moisture profile, but also to add to the drying capacity of a given machine if the desired treatment is started with an average moisture content in the web which is greater than the desired ultimate moisture content. In this event of course, the apparatus of the invention must be apprpriately dimensioned so as to be larger than would otherwise be the case, and the apparatus must be provided with heat sources as required by the greater drying capacity.

In connection with this latter type of method and apparatus, the present invention has at its objective in addition to achieving a uniform ultimate moisture content in the web also a simultaneous drying thereof, particularly a drying wherein the use of heat is carried out in such a way as to be more favorable than in conventional drying methods and apparatus. It is possible to achieve with the invention an advantageous heat economy, inasmuch as the air-free steam which evaporates in the treating apparatus of the invention is condensed in other parts of the apparatus such as, for example, in normal drying cylinders or, for example, in drying air after-heating radiators, or in both, or the steam may be utilized for other heating purposes such as, for example, at the wet end of the paper machine or even outside the machine. It is thus to be understood that part of the water which is removed from the web departs from the apparatus in the form of water and not steam. In addition, with respect to the moisture profile equilization which is carried out according to the method and apparatus of the invention, the apparatus required according to the invention can have such a small size that it may be situated immediately subsequent to the drying section of the paper machine or even between some of the drying cylinders thereof close to the drying end of the machine at the region where the moisture content of the web is in the hygroscopic range. The small size of the apparatus of the invention results from the fact that only a short web treatment interval is required, so that the length of the part of the web which is situated within the treating apparatus of the invention is short. The treating interval of the invention is short because the treating gas is drawn directly through the web thus creating the most efficient treatment contact possible at all of the surfaces of the fibers of the web, even those fibers in the interior of the web being subjected to the treatment so that water need not move in the web by diffusion through the thickness of the web.

The gas with which the web is treated according to the invention may be humid air having a temperature approximately the same as that of the dried web which enters the apparatus of the invention at the start of the method of the invention. It has been found, however, that when low moisture content differences are desired, for example, differences less than ±0.5%, the capacity of the air to release water as well as to take up water is so small at the final stage of the treatment of the invention that the treating interval requires a few seconds. Therefore, the use of humid equalizing air is of course to be considered as part of the present invention in connection with slow machines, but in association with modern high-speed paper machines, the apparatus of the invention would at any given time hold such a length of the web that on the one hand the apparatus would be bulky and on the other hand it would consume too much energy, because a considerable differential pressure is required for passing the treating gas through the web.

It is therefore advantageous in connection with high-speed paper machines to carry out the equalizing treatment of the invention with stream at atmospheric pressure with the steam having been slightly superheated to the extent of a few degrees above 100° C., with the air which is present in such a method and apparatus of the invention being only in a quantity which must be considered mainly as an impurity resulting from leakage. In this case the above-mentioned limitation of the capacity of the treating gas to receive and release water is not present, and the treating time can be made extremely short. At the start of the treatment, when the web is heated above 100° C., throughout the web steam is condensed, whereupon the actual moisture profile equalization according to the invention takes place. In a preferred embodiment of the invention the web is heated prior to the steam treatment of a temperature close to the treating temperature by way of, for example, a hot cylinder provided with an outside enclosure which reduces evaporation, so that a high web temperature can be achieved. However, this preliminary heating operation is not essential for the invention.

After the moisture profile equalization according to the invention has been achieved, the temperature of the web is higher than 100° C. and it therefore must be cooled prior to being wound onto a roll. For this purpose it is advantageous to use, for example, a cooling cylinder, a drying cylinder provided with a blower hood, or, for example, a perfusion cylinder wherein air consistent with equilibrium conditions is drawn through the web, primarily, however, with cooling in mind. Of course, particular care must be taken in every instance so that in the temperature equalizing step the temperature conditions are constant in a direction transverse to the direction of web travel, so that in this way no new moisture profile faults will be generated.

According to the method of the present invention, the web of sheet material which is treated, particularly a paper web, has been dried so as to be within the hygroscopic range. The web to be treated is continuously transported along a predetermined path through the interior of an enclosure which is closed off from the outer atmosphere with the web entering into the enclosure through an entrance region thereof and travelling out of the enclosure through an exit region thereof. As the web is transported along the interior of the enclosure a treating gas is passed through the web, this treating gas having at least at the exit region of the enclosure an equilibrium condition corresponding to the desired ultimate moisture content of the web. In this way as the web travels along the interior of the enclosure parts of the web having a moisture content greater than the desired moisture content will become drier and parts of the web having a moisture content less than the desired moisture content will gain moisture, with the average moisture content of the web closely approaching the desired moisture content by the time the web travels out of the enclosure at the exit region thereof. The treating gas may be either air at a given humidity or stream having predetermined properties.

The apparatus of the invention for providing a web of sheet material, particularly a paper web, which has been dried so as to be within the hygroscopic range, with a desired moisture content which is substantially uniform throughout the entire web, includes an enclosure means having a hollow interior for providing at this hollow interior a space which is closed off from the outer atmosphere. At least one rotary hollow profusion roll means is situated in the interior of the enclosure means to be lapped by a web of sheet material for transporting the web along the interior of the enclosure means. This profusion roll means has a foraminous wall through which a treating gas can pass with the treating gas first passing through a web lapping the profusion roll means before passing through the foraminous wall thereof into the interior of the profusion roll means. A gas-circulating means communicates with the interior of the enclosure means for circulating the treating gas out of the interior of the profusion roll means along a predetermined path directing the gas to travel back through a web lapping the profusion roll means and then through the foraminous wall of the profusion roll means into the interior thereof. This gas-circulating means provides the treating gas with predetermined properties while the gas is circulated. An inlet means is operatively connected with the enclosure means at an entrance region thereof for introducing a web of sheet material in a fluid-tight manner into the interior of the enclosure means to be lapped onto the profusion roll means. An outlet means is also operatively connected with the enclosure means at an exit region thereof for receiving a web of sheet material from the profusion roll means and for directing the web which has been treated by the treating gas in a fluid-tight manner out of the enclosure means.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
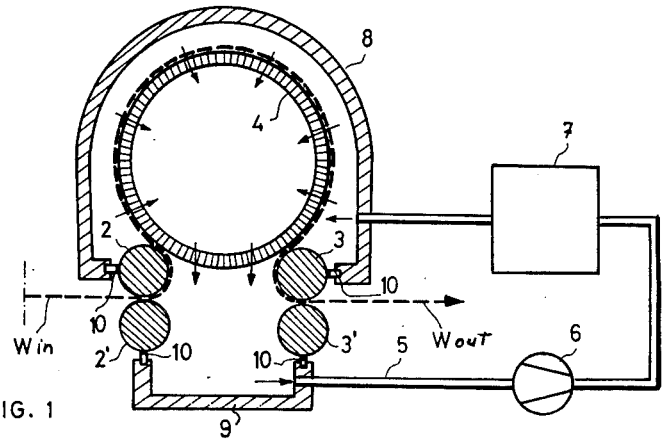
FIG. 1 is a partly sectional schematic illustration of an apparatus of the invention for carrying out the method of the invention.

Before proceeding with a description of the method and apparatus in connection with the drawings, there is presented below calculations in connection with examples pertaining to the method of the invention and the advantages thereof.

It is to be noted that according to the invention the web which is treated as a rule is not only in equilibrium with humid air (in which case it is essential that in the equilibrium conditions the vapor pressure of water in the web equals the partial pressure of water in the humid air) or with atmospheric steam superheated to a suitable temperature, but also with steam that is at a certain pressure greater than atmospheric pressure and which has been superheated to an even higher temperature. Between different absolute temperatures T and $T_o$ of a given web having certain moisture content, and the respective vapor pressures p and $p_o$ of water in the web, the following relationship is approximately valid:

$$1/T_o - 1/T = C \log p/p_o$$

where $C$ is a constant depending upon the moisture content. For example, the mutually corresponding values of web temperature t and vapor pressure p of water in the web may be of the following type, e.g. in a web dried so as to have an 8% moisture content:

| | | | | | | | |
|---|---|---|---|---|---|---|---|
| T = | 50 | 60 | 80 | 108 | 126 | 138 | °C |
| p = | 0.07 | 0.12 | 0.31 | 1 | 2 | 3 | bar |
| x = | 0.047 | 0.085 | 0.279 | — | — | — | kg/kg |

In the above table there has also been calculated for pressures $p < 1$ bar, the moisture content $x$ of air at 1 bar corresponding to the different $p, t$ pairs, so that the latter air is also in equilibrium with the particular web.

It is advantageous, although not indispensible, to use in the apparatus in which the web is treated according to the invention so as to be dried as well as to have moisture equalization as a treating gas, a pressurized steam which is superheated according to the final moisture content. For example, steams of 1, 2 and 3 bar in the above table have been superheated to 108°, 126° and 138° C., respectively, the saturation temperatures respectively being approximately 100°, 120° and 133° C. This is done because on the one hand steam obtained from the treating apparatus is easier to maintain in an air-free condition when the apparatus operates with over-pressure (greater than atmospheric pressure), and on the other hand the higher condensation temperature of the steam which leaves the apparatus is favorable when it is condensed as, for example, in a drying cylinder.

Assuming that the web arrives at the apparatus of the invention to commence treatment according to the method of the invention at a temperature of 80° C., with an apparatus wherein according to the invention in addition to equalizing of the final moisture content the web is also dried, with the assumption being that the state of the steam evaporating from the web is: 2 bar, 125° C., 2716 kJ/kg, and that into the radiators of the heat-exchanging means which heats the circulating steam heating steam is supplied in a state: 4 bar, 150° C., 2752 kJ/kg., and also it is assumed that the condensate departing from the apparatus is saturated so that its specific enthalpy is 605 kJ/kg.

When for the sake of simplicity heat losses and leakage, the heating of the web and the absorption heat of water evaporating from the web within the hygroscopic range are neglected, so that the specific enthalpy of the incoming 80° C. water is 335 kJ/kg, the proportion of the mass flows of drying steam and water evaporated from the web is:

$$\frac{2716 - 335}{2752 - 605} = 1.11 \text{ kg. steam per kg water evaporated.}$$

If the steam evaporated in the apparatus is then used to bring about drying by supplying it, for example, to conventional drying cylinders following after the press section of a paper machine, if the condensate produced is saturated (specific enthalpy 505 kJ/kg), and if the specific heat consumption is as usual, e.g. 2950 kJ/kg, then the evaporation obtained with this steam flow amounts to $$\frac{2716 - 505}{2950} = 0.75 \text{ kg per kg steam from the profile corrector.}$$

It is thus found that with 1.11 kg of heating steam 1 + 0.75 = 1.75 kg dewatering of the web is produced, and 1 kg thereof departs as condensate from the cylinders. In the extreme case, if the drier were so dimensioned that the evaporation in the profile corrector accounted for the steam requirements of the cylinder section, the specific heat consumption would be $$\frac{1.11\,(2752 - 605)}{1.75} = 1362 \text{ kJ/kg,}$$

that is less than half of the above-mentioned conventional value of a conventional machine, namely 2950 kJ/kg. If the profile corrector is dimensioned so as to be smaller then part of the drying cylinders must be supplied with counterpressure steam coming directly from the steam power plant, and the average heat consumption increases. If, for example, in a machine with an initial dryness of 40% (water content 1.50 kg $H_2O$ per kg dry matter) and with a final moisture content of 8% (water content 0.09 kg $H_2O$ per kg dry matter), the web is dried with steam drawn through the web in the profile corrector only in the whole hygroscopic range from about 30% (from water content 0.43 kg $H_2O$ per kg dry matter) to its final dryness, then the quantity of steam produced from the total dewatering $1.50 - 0.09 = 1.41$ kg $H_2O$ per kg dry matter in the profile corrector is $0.43 - 0.09 = 0.34$ kg $H_2O$ per kg dry matter, so that of the total dewatering the fraction $1.75 \cdot 0.34 = 0.60$ kg $H_2O$ per kg dry matter takes place with the specific heat consumption of 1362 kJ/kg, and the rest, $1.41 = 0.60 = 0.81$ kg $H_2O$ per kg dry matter, with heat consumption of 2950 kJ/kg, so that the average specific heat consumption is $$\frac{0.60 \cdot 1362 + 0.81 \cdot 2950}{1.41} = 2274 \text{ kJ/kg},$$

which is about ¾ of conventional consumption.

It is important to note that when the profile corrector also dries the web according to the invention, the state of the steam need not in the entire apparatus be in equilibrium with the desired final moisture content of the web. It is sufficient if this equilibrium state prevails in a requisite part of the apparatus which is close to the exit region thereof, or in other words at the final stage of the treatment method according to the invention. Thus, even though the properties of the treating gas, such as steam, may vary at different parts of the interior of the enclosure means, these properties are precisely controlled at the exit region of the enclosure means where the web travels out of the enclosure means at the final stage of the method of the invention, inasmuch as the treating gas is introduced into the enclosure means in the above manner at the exit region thereof. Therefore, while the web is approaching the desired equilibrium condition while travelling forward toward the exit region of the enclosure means, by the time the exit region is reached by the web, the latter has closely approached the desired condition and at this time encounters only treating gas in the desired equilibrium condition, thus assuring that the web at the end of the method of the invention exiting from the enclosure means has the desired moisture profile.

Referring now to the method and apparatus of the invention as illustrated in FIG. 1, there is schematically illustrated therein a web W which is to be treated according to the invention, this web being, for example, a paper web which has been dried so as to be within the hygroscopic range and which is to be treated according to the invention so that the moisture profile thereof will be properly rectified. The portion of the web which enters into the apparatus of the invention to commence treatment according to the method of the invention is indicated at W in, while the part of the web which has been treated and which leaves the apparatus of the invention is indicated at W out. The illustrated apparatus includes an enclosure means having portions 8 and 9 closed off from the outer atmosphere so that this enclosure means has a hollow interior for providing a space which is closed off from the outer atmosphere. At an entrance region of the enclosure means 8, 9 an inlet means is provided for introducing the web in a fluid-tight manner into the interior of the enclosure means. The illustrated inlet means includes a pair of rotary sealing rolls 2, 2' between which the web passes so as to be transported by the rolls into the enclosure means 8, 9. An outlet means is provided for transporting the web out of the enclosure means 8, 9 at an exit region thereof, and the illustrated outlet means includes a pair of sealing rolls 3, 3' which serve to transport the treated web out of the enclosure means in a fluid-tight manner. Between the inlet and outlet means the web is lapped over a perfusion roll means 4 which serves to transport the web from the inlet to the outlet means while directing the web along a predetermined path in the interior of the enclosure means 8, 9. This perfusion roll means 4 takes the form of a suitable hollow rotary cylinder having a foraminous wall. This wall may be made of a suitable sheet material formed with a large number of relatively small closely spaced openings, or it may take the form of a suitable sintered material having a sufficient porosity to provide for relatively free flow of the treating gas through the foraminous wall of the perfusion roll means 4. While only one perfusion roll means 4 is shown in FIG. 1, it is to be understood that a plurality of such rolls may be provided, in which case of course the enclosure means 8, 9 would be made sufficiently large to accommodate such a plurality of perfusion rolls. In the illustrated example the treatment gas is drawn, as shown by the arrows, first through the web at its portion which laps perfusion roll means 4 and then through the wall thereof into the interior of the perfusion roll means. The part of the perfusion roll means 4 which is lapped by the web defines with the portion 8 of the enclosure means a receiving interior portion for receiving treating gas. The part of the perfusion roll means 4 which is not lapped by the web W defines with the inlet means 2, 2' and the outlet means 3, 3', as well as with the portion 9 of the enclosure means a discharge interior portion of the enclosure means which receives gas from the interior of the perfusion roll means, this latter gas travelling through the part of the perfusion roll means situated between the inlet and outlet means and which is not lapped by the web, and the gas in the discharge interior portion of the enclosure means is withdrawn from the enclosure means by way of a gas-circulating means 5 which serves to direct the gas back into the receiving interior portion of the enclosure means after the gas has been conditioned so as to have the required properties. Thus, in the illustrated example the gas-circulating means 5 includes not only a suitable pipe system but also a blower 6 for sucking the gas out of the discharge interior portion of the enclosure means and returning the gas to the receiving interior portion of the enclosure means. Subsequent to the blower 6 the gas-circulating means 5 includes a unit 7 which conditions the flowing treating gas. FIG. 1 also shows suitable sealing strips 10 which engage the sealing rolls 2, 2' and 3, 3' in the manner illustrated so as to maintain the interior of the enclosure means sealed off from the outer atmosphere. It is to be understood that the rolls 2, 2' and 3, 3', as well as the perfusion roll means 4 are supported for rotary movement and driven in any conventional manner so as to provide for travel of the web W in the manner indicated in FIG. 1. Furthermore, these rolls and perfusion cylinder as well as the portions 8 and 9 of the enclosure means are provided whereever required with gas-tight components such as, for example, gas-tight stuffing boxes on the rotary shaft portions.

Thus, with the embodiment of FIG. 1 the web W is introduced by way of the sealing rolls 2, 2' into the interior of the enclosure means 8, 9 to travel from the rolls 2, 2' over the perfusion roll means 4, and then from the latter out of the enclosure means by way of the pair of sealing rolls 3, 3'. The blower 6 will circulate the treating gas which has travelled through the web, this gas travelling through the treating unit 7 before returning to the enclosure means again to travel through the web and into the perfusion roll means 4 back to the suction side of the enclosure means situated at the discharge interior portion thereof.

The equalizing of the moisture distribution in the web W, which is the primary aim of the present invention, is brought about by treating the gas in the unit 7 so that the gas will have a state which is in equilibrium with the web at the desired final moisture content. If the treating gas is humid air, then the unit 7 is an air conditioning apparatus which is in itself known and by means of which the temperature of the treating air as well as the humidity thereof are both regulated as desired. If the treating gas is steam, then the unit 7 is simply a radiator forming a heat exchanger by means of which superheating of the treating steam is maintained constant. As the treating gas flows through the web W, the parts thereof which have a moisture content greater than the desired moisture content will dry out while the parts thereof which have less then the desired moisture content will acquire moisture, with both of these parts approaching more closely to the desired average moisture content. The average moisture content is not necessarily to be understood as the exact mean value of the moisture profile.

Figure 2:
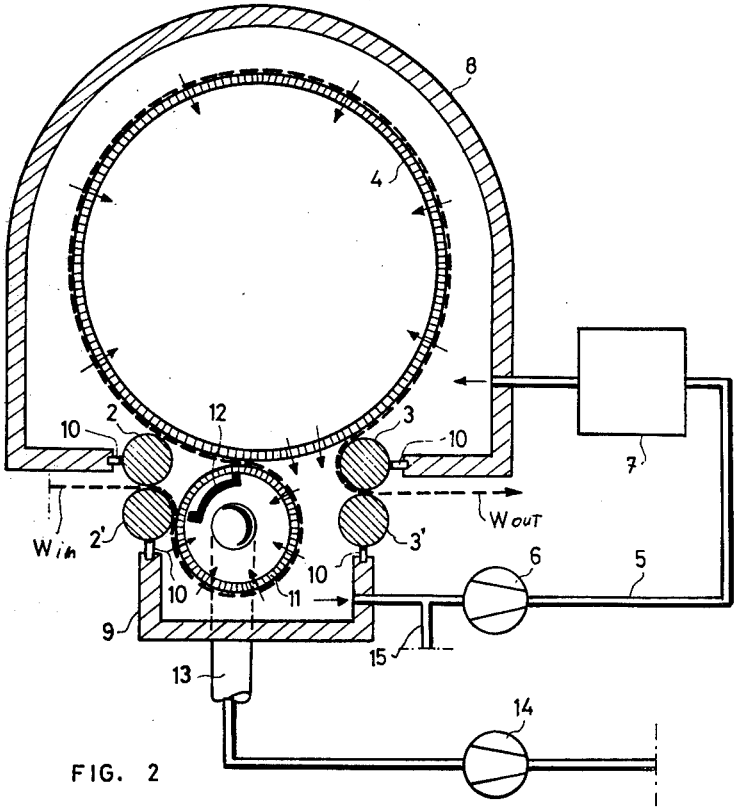
FIG. 2 is a partly sectional schematic illustration of a further embodiment of the invention.

THe embodiment of the invention which is illustrated in FIG. 2 differs from that of FIG. 1 in that between the inlet means 2, 2' and the perfusion roll means 4 there is an additional perfusion roll means 11 identical with the perfusion roll means 4 except that the roll means 11 has a smaller diameter. Thus, this additional smaller-diameter perfusion roll means 11 is situated in the discharge interior portion of the enclosure means 8, 9 at the suction side thereof. The web W after being introduced by way of the inlet means 2, 2' first has an initial portion which travels around the smaller perfusion roll means 11 before reaching the perfusion roll means 4, in the manner illustrated in Fig. 2. A suction means 13 communicates with the interior of the smaller perfusion roll means 11 to form a gasremoving means which removes gas from the interior of the roll means 11 without returning this removed gas back to the interior of the enclosure means. Thus, this means 13 takes the form of a suitable pipe which communicates with the interior of the roll 11 and which is operatively connected with a blower 14 which extracts gas from the interior of the roll means 11. An interior baffle or shield is provided in the perfusion roll means 11, with this baffle or shield 12 remaining at the location indicated in FIG. 2 where the roll means 11 is not lapped by the web W. For this purpose the end wall of the roll 11 which is connected to the pipe 13 may be stationary and may carry the shield or baffle 12, with the periphery of this end wall being slidably engaged in a fluid-tight manner by the foraminous cylindrical wall of the roller means 11, and the opposite end of the roll means 11 is fixed to its cylindrical wall and is connected to a suitable rotary shaft which is driven, so that in this way the roll means 11 is capable of rotating to bring about the required transportation of the web to the rotary perfusion roll means 4.

Thus it will be seen that with the embodiment of FIG. 2 the gas drawn out of the interior of the perfusion roll means 4 will in part be circulated in the manner described above by way of the circulating means 5 and in part be drawn into the additional perfusion roll means 11 to be extracted from the interior thereof by way of the means 13, 14. By way of this latter expedient there is a by-pass flow seving the purpose of flushing from the system air which otherwise would be introduced by way of the web W, such air being entrained in the pores thereof. Such air if not flushed out in the manner shown in FIG. 2 would, particularly where the treatment gas is steam, impede the maintenance of a constant state of the treating gas flow. The pipe 15 schematically indicated in FIG. 2 is used for supplying additional treating gas (particularly steam) in a quantity sufficient to make up for loss such as losses which unavoidably occur due to escaping gas flow.

Figure 3:
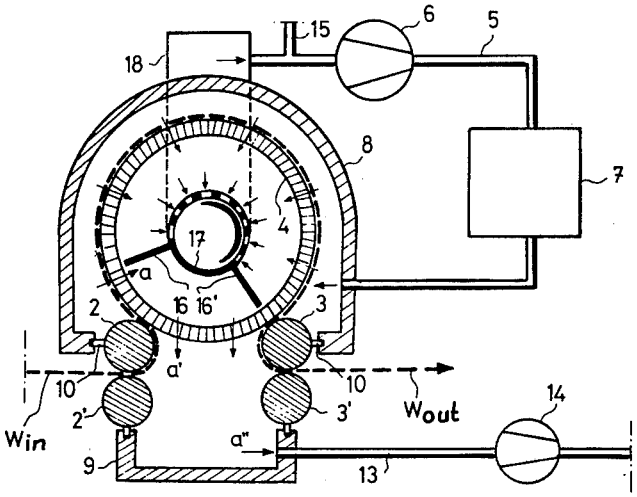
FIG. 3 is a partly sectional schematic illustration of yet another embodiment of an apparatus of the invention for carrying out a method according to the invention.

It is to be noted that for the purpose of flushing out of the system air entrained in the pores of the web, it is not essential to provide an additional perfusion roll means 11 as shown in FIG. 2. Thus, FIG. 3 shows an embodiment of the invention where a portion of the perfusion roll means 4 is utilized for this purpose. Thus, with this embodiment one end of the roll means 4 may be stationary and fluid-tightly engaged at its periphery by the rotary foraminous wall of the roll means 4, the other end of which is fixed to the foraminous wall and supported for rotation and driven. This stationary end of the roll means 4 carries in the interior of the roll means 4 a tube 17 from which a pair of partitions 16 and 16' extend radially in the manner indicated in FIG. 3. The lower part of the tube 17 shown in FIG. 3 extending between the partitions 16 and 16' is imperforate, while the remainder of the tube 17 is formed with a multiplicity of openings as illustrated. The gas-circulating means 5 of the embodiment of FIG. 3. includes a tubular portion 18 communicating outside of the enclosure means 8, 9 with an end of the stationary interior pipe 17 of the perfusion roll means 4, so that gas which passes through the major part of the web lapping the perfusion roll means 4 is drawn out through the pipe 17 and along the pipe 18 through the remainder of the gas-circulating means 5 to be returned to the receiving interior portion of the enclosure means defined between the perfusion roll means 4 and the portion 8 of the enclosure means, as illustrated in FIG. 3 and described above. While the right radial partition 16' of FIG. 3 extends to the region of the roll means 4 which is situated at the upper sealing roll 3 of the outlet means, the left partition 16 is angularly displaced beyond the inlet means 2, 2' in the manner illustrated in FIG. 3, so that the initial part of the web which initially is introduced by way of the inlet means has the treating gas flowing therethrough in the direction indicated by the arrow *a* to be received in the lower interior portion of the perfusion roll means 4 between the partitions 16 and 16'. This flushing gas will be drawn out of the interior of the perfusion roll means as indicated by the arrows *a'*, to flow as indicated by the arrow *a''* into the suction means 13, 14, so that in this way flushing of entrained air is achieved with the embodiment of FIG. 3 without requiring an additional perfusion roll means 11 as shown in FIG. 2.

Figure 4:
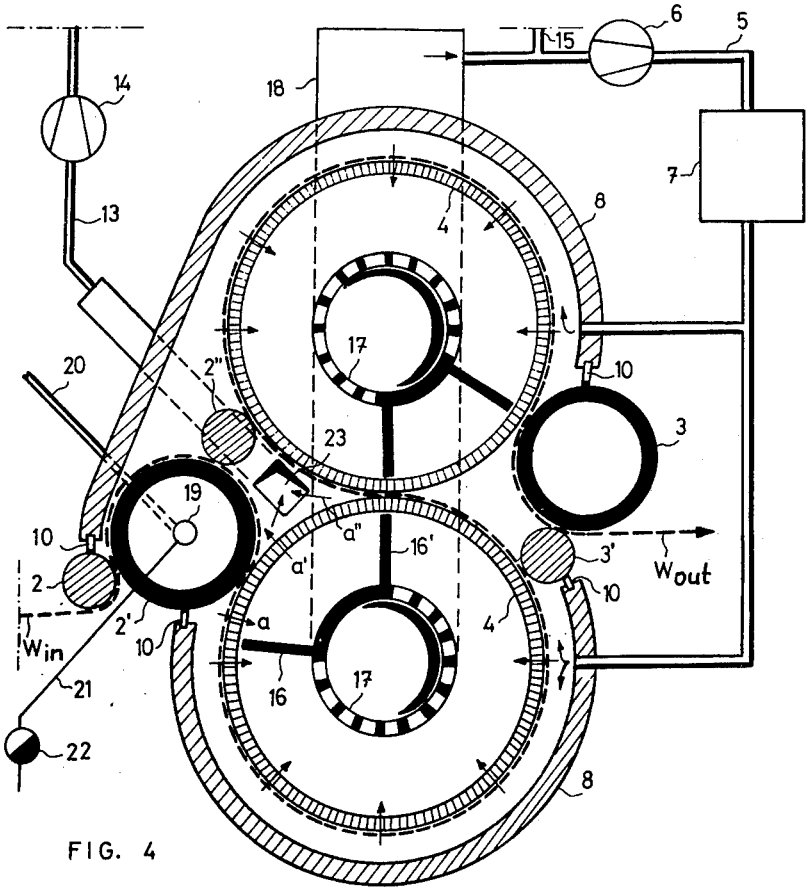
FIG. 4 is a partly sectional schematic illustration of a further embodiment of a method and apparatus according to the invention.

In the embodiment of the invention which is illustrated in FIG. 4, there are a pair of perfusion roll means 4 around which the web W is guided in the manner illustrated, so that the web travels along an approximately S-shaped path in the interior of the enclosure means 8, 9 of this embodiment. In this embodiment the inlet means includes three sealing rolls 2, 2' and 2'', as illustrated, with the intermediate roll 2' serving as a preheating cylinder for preheating the web prior to the time when the web reaches the perfusion roll means 4. For heating purposes a suitable heating means is operatively connected with the sealing roll 2' which has a larger diameter than the other rolls 2 and 2'' as illustrated in FIG. 4. In the illustrated example the heating means includes a steam pipe 19 extending along the axis of the sealing roll 2' in the interior thereof, this pipe 19 receiving steam from a suitable supply pipe 20. Thus, the pipe 19 is heated by steam and transfers this heat to the outer cylinder of the sealing roll 2' so that this roll 2' is at an elevated temperature for preheating the web. The condensate which forms in the pipe 19 is drained by way of the schematically illustrated pipe 21. The condensate drain pipe 21 transmits the condensate to a condensate separator 22. The pipe 19 is connected to the pipes 20 and 21 at portions of the pipe 19 which extend outwardly beyond the interior of the enclosure means 8, 9.

As is apparent from FIG. 4, the lower perfusion roll means 4 has in its interior a pipe 17 similar to the pipe 17 of FIG. 3 and having the radial partitions 16 and 16' providing in this way for the flow of treating gas in the direction of the arrow *a* through the web immediately subsequent to the heating roll 2' so as to flush entrained air out of the web into the separate interior space of the lower perfusion roll means 4 of FIG. 4 defined between the partitions 16 and 16' at the upper left portion of the lower roll 4 in FIG. 4. This treating gas with the flushed out entrained air can then flow in the direction indicated by the arrow *a'* into the space defined by the pair of perfusion rolls 4, the preheating roll 2' and the sealing roll 2'', this space being limited at its ends by the opposed end walls of the enclosure means, one of which is shown in FIG. 4. This latter end wall is formed with an opening 23 in the space which receives the treating gas with the flushed out entrained air, and the opening 23 communicates with the suction means 13, 14, so that the treating gas with entrained air can discharge as shown by the arrow *a''*.

The upper perfusion roll means 4 of FIG. 4 is provided in its interior with a pipe 17 similar to that of FIG. 3 but having its radial partitions arranged as shown in FIG. 4, and both of the pipes 17 communicate with the pipe 18 which forms part of the circulating means 5 as illustrated in FIG. 4. Downstream of the unit 7 the circulating means 5 has a pair of pipes delivering the treating gas to the upper and lower portions 8 of the enclosure means which respectively define with the pair of perfusion roll means 4 a pair of receiving interior portions of the enclosure means both of which receive the treating gas which passes through the web into the interior of the pair of perfusion roll means 4 and from the latter through the perforated portions of the pipes 17 into the interiors thereof to again be received by the pipe 18 as illustrated in FIG. 4.

In addition, with the embodiment of FIG. 4 the sealing roll 3 of the outlet means is formed as a cooling roll, although both of the sealing rolls 3 and 3' can serve a cooling function if desired. Thus, the larger hollow sealing roll 3 shown in FIG. 4 communicates in any suitable way with a fluid such as a suitable gas or liquid which has been chilled to a suitable low temperature by way of a suitable cooling apparatus with this cooling fluid flowing through the roll 3 so that the web W is cooled as it is discharged through the outlet means formed by the sealing rolls 3 and 3'.

The above-described embodiments of FIGS. 1–4 may operate not only to equalize the moisture profile of the web but also to give the web a drying treatment so as to increase the drying capacity of the machine, in which case the web which enters into the enclosure means has a moisture content greater than the desired average moisture content. For this purpose the apparatus of the invention must have the requisite amount of heating surface for achieving the desired drying effect. If, as is advantageous, the circulating steam which forms the treating gas has a pressure greater than atmospheric pressure, the walls of the enclosure means 8, 9 are dimensioned so as to be capable of withstanding this pressure. In the event that the apparatus is provided with an unusually great drying capacity and the perfusion roll means are of a conventional size then it is preferred to use any of the embodiments of FIGS. 1–4 but with additional perfusion rolls, which is to say a number of perfusion rolls greater than shown in FIGS. 1–4, so as to achieve in this way the required drying capacity.

It is furthermore to be noted in connection with FIGS. 1–4 that the treating gas which is delivered by the gas-circulating means 5 into the enclosure means at the receiving interior portion thereof defined between a perfusion roll means 4 and the portion 8 of the enclosure means is always delivered into this receiving interior portion at the exit region of the enclosure means so that at least at the exit region the treating gas has the desired equilibrium state which is closely approached by the web which is treated.

Figure 5:
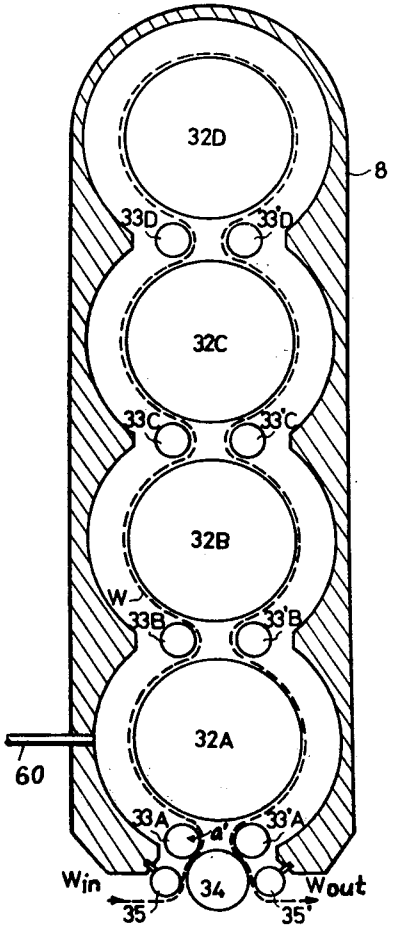
FIG. 5 is a partly sectional and schematic illustration of a further method and apparatus according to the invention.

FIG. 5 shows schematically and partly in section a further embodiment of the invention. According to this embodiment there are a plurality of perfusion roll means 32A, 32B, 32C, and 32D arranged one above the other as illustrated in FIG. 5. These vertically arranged perfusion rolls are situated relatively close to each other within a pressure-resistant housing 8 which forms the enclosure means of this embodiment. The several units 32A–32D are situated one above the other as illustrated so as to conserve space, and each of these units includes in addition to a perfusion roll means a circulating means for circulating the gas, the circulating means including gas blowing and heating means for each perfusion roll means as described below. A single drying machine may have one or several units as shown in FIG. 5 situated either in a common housing or in separate housings as required by the desired drying capacity.

The web W is conducted through the interior of the enclosure means 8 in the manner shown in FIG. 5 with the aid of pairs of web-guiding roll means 33A, 33'A, 33B, 33'B, 33C, 33'C and 33D, 33'D. Each of these web-guiding rolls may be a foraminous roll and constructed as a suction roll, thus serving with the several perfusion roll means to guide the web W in the desired manner through the apparatus. However, the first web-guiding roll 33A may also serve to remove air entrained in the web as it enters into the enclosure means 8. Thus, steam passes through the web in the direction of the arrow *a'* into the interior of the webguiding roll 33A to be extracted out of the interior thereof in the manner described above, for example, so as to withdraw from the enclosure means treating gas with entrained air which is flushed out of the web. Of course, this steam-/air mixture is removed as a separate flowing stream by way of, for example, a hollow shaft situated in the interior of the roll 33A. In the example of FIG. 5, the inlet means is formed by the sealing rolls 34 and 35 while the outlet means is formed by the sealing rolls 34 and 35', so that in this embodiment the intermediate sealing roll 34 is common to the inlet and outlet means.

Figure 6:
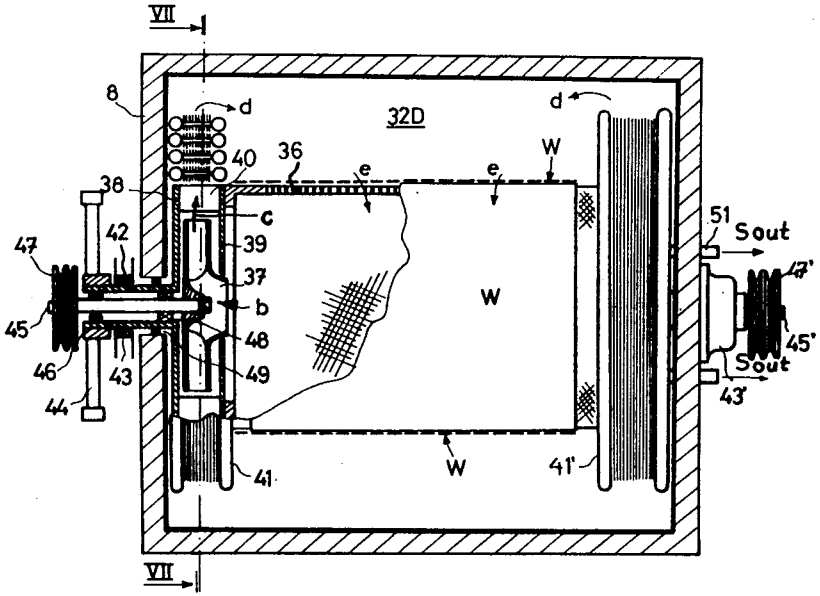
FIG. 6 is a partly broken away transverse sectional plan view of an apparatus and method of the invention as illustrated in FIG. 5, with FIG. 6 being taken along line VI—VI of FIG. 7 in the direction of the arrows.
Figure 7:
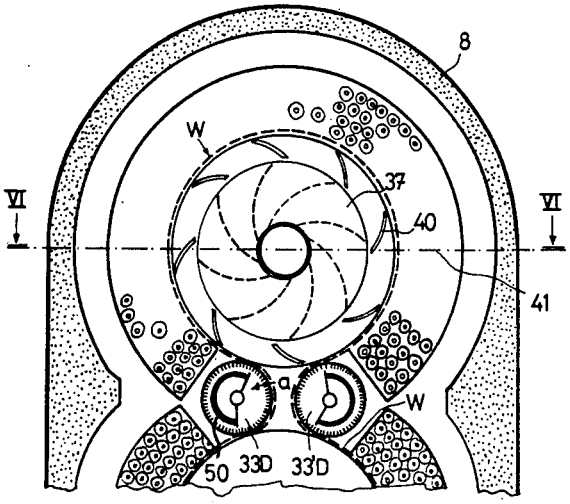
FIG. 7 shows the structure of FIG. 6 in a sectional elevation taken along line VII—VII of FIG. 6 in the direction of the arrows.

The details of the top unit 32D and the pair of guide-roll means 33D, 33'D cooperating therewith are illustrated in FIGS. 6 and 7, and it will be understood that the remaining perfusion rolls beneath the roll 32D and the several web-guiding roll means cooperating therewith are also constructed in a manner shown in FIGS. 6 and 7 and described below. Thus, it will be seen that the web W laps the foraminous cylindrical wall of the perfusion roll means 32D. This foraminous wall 36 is illustrated in FIG. 6. The foraminous cylindrical wall 36 of the perfusion roll means 32D is fixed at its opposed ends to a pair of end plates 39 each of which is formed with a central opening receiving the inlet of a rotary impeller means 37 which forms a blower of the gas-circulating means of this embodiment. Thus, the pair of opposed blowers or impellers 37 are coaxial with and communicate with the interior of the perfusion roll means 32D. Each end plate 39 also forms part of the casing of the blower, this casing including an outer rotary wall 38 fixed to the inner wall or plate 39 by way of the transversely extending vanes 40 which are also illustrated in FIG. 7. Thus, the gas which is radially blown outwardly by each impeller 37 is deflected by the vanes 40 to travel outwardly beyond the perfusion roll means. Each outer end plate 38 is fixed with a tubular shaft 42 supported for rotation by a bearing structure 49 in an opening of the enclosure means 8, so that by way of the hollow shaft 42, the plate 38, the vanes 40, and the plate 39, the perfusion roll means 32D is supported for rotation at its ends. A pair of heating means 41 and 41' are mounted in the enclosure means 8 around the vanes 40 of each blower means in the manner illustrated. These heaters 41 and 41' are mounted in any suitable way in the interior of the enclosure means 8 and are formed with tube networks receiving in their interior heating steam, these tubes of each heating means having fins and forming radiators through which the treating gas received from each blower means travels so that the required properties are provided for the treating gas which is thus heated to the temperature required by the drying or by the web-conditioning. Thus, gas from the interior of the perfusion roll means travels into the blower 37 in the direction shown by the arrow *b*, to be discharged from the impeller as shown by the arrow *c*, thus flowing between the deflecting vanes 40 to be received by the heat exchanger 41, and flowing out of the latter in the direction indicated by the arrow *d* to return to the web which laps the perfusion roll means. While these gascirculating structures are duplicated at opposite ends of the perfusion roll means, it is possible to provide the gascirculating structure at only one end of each perfusion roll means, if desired.

Just beyond the enclosure means 8 each hollow shaft 42 is supported for rotation by a bearing 43, with a similar bearing 43' being provided at the opposite side of the enclosure means 8, as shown in FIG. 6. The left hollow shaft 42 of FIG. 6 is fixed with a gear 44 driven from any suitable transmission so as to rotate the perfusion roll means for transporting the web through the interior of the enclosure means.

The shafts 45 and 45' which are fixed to the impellers extend coaxially through the hollow interiors of the shafts 42, supported therein by way of a suitable bearing 46. Each of these shafts 45 and 45' is fixed with a V-belt pulley 47, 47' by means of which the impellers are driven independently of the perfusion roll means. Where a bearing 43 is provided just outside of the enclosure means 8, the component 49 may form a suitable seal for the shaft 42, and in the same way an additional seal 48 is provided between the shaft 42 and the impeller shaft 45.

FIG. 7 shows in a vertical schematic section the structure of FIG. 6 as well as the details of the pair of web-guiding roll means 33D and 33'D. Thus, as is apparent from FIG. 7, each heating means 41, 41' does not extend entirely around the axis of the perfusion roll means. Instead each heating means is interrupted to accommodate the pair of web-guiding roll means.

As is apparent from FIG. 7, each web-guiding roll means 33D and 33'D has a cylindrical wall which is foraminous so that gas can pass through this wall into the interior of the web-guiding roll means, as indicated by the arrow *a* in FIG. 7. In the interior of each web-guiding roll means there is a shield or baffle 50 which prevents steam from entering into the web-guiding roll means except at the portion thereof which is lapped by the web.

Figure 8:
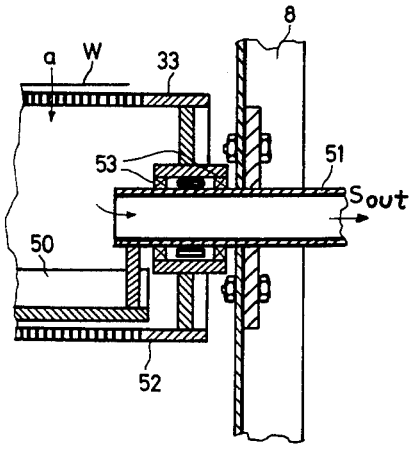
FIG. 8 is a fragmentary sectional illustration of details in connection with discharge of fluid out of a web-guiding roll means of FIGS. 5–7.

Thus, with this embodiment of the invention the impellers 37 draw the circulating steam from the interior of the foraminous cylinder in the direction of the arrow *b* and blow the steam in the direction of the arrows *c* and *d* through and between the guide vanes 40 and through the heat exchangers 41, 41' to the exterior of the perfusion roll means. The circulating steam which is thus heated to a suitable temperature is then drawn in the direction shown by the arrows *e* through the web into the interior of the perfusion roll means. At each of these perfusion roll means where in addition to equilization of the moisture profile there is also evaporation, or where simply drying of the web takes place, the additional steam flow corresponding to the evaporation passes first through the foraminous wall 36 from the interior thereof into the space between the web-guiding rolls 33D, and 33'D, and then in the direction of the arrow *a* into the interiors of these webguiding rolls at least mainly or partly through the web engaging the web-guiding rolls. From the interiors of these rolls and evaporated steam is removed from the apparatus, for example, through hollow shafts 51 which respectively communicate with the interiors of the several web-guiding roll means. This construction is illustrated in FIG. 8. Additional steam, if required, is supplied to the apparatus from any suitable source by way of the valve-controlled pipe 60 schematically shown in FIG. 5.

From the discharge pipes 51 the evaporated steam is supplied by an unillustrated pipe system to a suitable location where use is made of the extracted steam, this steam being used, for example, at the conventional drying part of the drying apparatus where contact-drying is carried out, and where the steam is condensed and thereby participates in the drying process. The discharge of the steam at each hollow shaft or pipe 51 has been indicated by the arrow S out in FIG. 8 as well as in FIG. 6.

Referring to FIG. 8, each shaft 51 may be a stationary shaft fixed in any suitable way to the wall of the enclosure means 8. At its inner end the shaft 51 fixedly carries the baffle or shield 50. Each web-guiding roll 33 fixedly carry at each of its opposed ends a bearing structure 52 by means of which each guide roll is supported for rotation on the shaft 51, with suitable sealing glands or packings 53 being provided as illustrated. If desired only the shafts 51 at the right of the enclosure means 8, as viewed in FIG. 6, are hollow, while the corresponding shafts 51 at the left are solid so that gas is extracted only through the hollow right shafts 51, as indicated in FIG. 6. Thus, the steam that flows out in the direction shown by the arrow *a* in FIG. 8 after travelling through the web departs from the apparatus through the hollow shaft 51 and is collected in a steam-collecting pipe system which is common to the several shafts 51 through which the steam flows out of the apparatus. The quantity and pressure of the steam in the rolls 33 are regulated by suitable valves in the pipe system.

Of course, the invention is not confined to the details set forth above and shown in the drawings, inasmuch as these details may vary within the scope of the inventive concept as defined by the claims which follow.

What is claimed is:

1. Apparatus for providing a web of sheet material, particularly a paper web, which has been dried so as to be within the hygroscopic range, with a desired moisture content which is substantially uniform throughout the entire web, comprising enclosure means having a hollow interior for providing at said hollow interior a space which is closed off from the outer atmosphere, at least one rotary hollow perfusion roll means situated in the interior of said enclosure means to be lapped by a web of sheet material for transporting the web along the interior of said enclosure means, said perfusion roll means having a foraminous wall through which a treating gas can pass with the treating gas first passing through a web lapping said perfusion roll means before passing through said foraminous wall thereof into the interior of said perfusion roll means, gas-circulating means communicating with the interior of said enclosure means for circulating the treating gas out of the interior of said perfusion roll means along a predetermined path directing the gas to travel back through a web lapping said perfusion roll means and then through the foraminous wall thereof into the interior of said perfusion roll means, said gas-circulating means providing the treating gas with predetermined properties while the gas is circulated along said path, inlet means operatively connected with said enclosure means at an entrance region thereof for introducing a web of sheet material in a fluidtight manner into the interior of said enclosure means to be lapped onto said perfusion roll means, outlet means operatively connected with said enclosure means at an exit region thereof for receiving a web of sheet material from said perfusion roll means and for directing the web which has been treated by the treating gas in a fluid-tight manner out of said enclosure means, said web of sheet material having an initial portion situated immediately subsequent to said inlet means in said enclosure means, the latter having in its interior a foraminous wall portion engaging and guiding said initial portion of said web prior to continued travel of the web of sheet material around said perfusion roll means, and gas-removing means communicating with a space at a side of said foraminous wall portion which is opposite said initial portion of said web for drawing treating gas through said initial portion of said web and through said foraminous wall portion into said space with which said gas-removing means communicates, said gas removing means removing the gas which travels through said initial portion of said web out of the interior

2. The combination of claim 1 and wherein said inlet and outlet means each includes a pair of rotary sealing rolls between which the web travels.

3. The combination of claim 1 and wherein said inlet and outlet means together with a portion of said perfusion roll means which is not lapped by said web and with a portion of said enclosure means define a discharge interior portion of said enclosure means with which said gas-circulating means communicates for withdrawing gas from the interior of said perfusion roll means through the wall thereof into said discharge interior portion of said enclosure means and out of the latter through said gas-circulating means, the portion of said perfusion roll means which is lapped by said web defining with another portion of said enclosure means a receiving interior portion thereof communicating with said gascirculating means for receiving therefrom gas for passing through the web and into the interior of said perfusion roll means.

4. The combination of claim 1 and wherein said foraminous wall portion which engages said initial portion of said web is formed by a second perfusion roll means of a smaller diameter than said first-mentioned perfusion roll means situated between the latter and said inlet means for first receiving the web from said inlet means before the web travels from said second perfusion roll means to said first-mentioned perfusion roll means, and said gas-removing means communicating with the interior of said second perfusion roll means for withdrawing the gas therefrom, so that part of the treating gas passes through the web engaging said second perfusion means to flush out of the web air entrained therein prior to travel of the web to said first-mentioned perfusion roll means.

5. The combination of claim 1 and wherein a pair of said perfusion roll means are situated in said enclosure means for directing the web along a substantially S-shaped path through the interior of said enclosure means.

6. The combination of claim 2 and wherein at least one of said sealing rolls at said inlet means is hollow, and heating means operatively connected with said hollow sealing roll of said inlet means for heating the latter so that through the latter sealing roll the web is preheated prior to reaching said perfusion roll means.

7. The combination of claim 2 and wherein one of said sealing rolls of said outlet means is a cooling roll for reducing the temperature of the web as the latter travels out of the enclosure means.

8. The combination of claim 1 and wherein said gas-circulating means includes at each end of said perfusion roll means an impeller means for extracting gas from the interior of said perfusion roll means and for driving the gas radially outwardly from the axis of said perfusion roll means, a plurality of vanes located at each end of said perfusion roll means for receiving the gas from said impeller means and for directing the gas outwardly away from said impeller means, and heat-exchanger means extending at least partly around said plurality of vanes at each end of said perfusion roll means for receiving the gas from said vanes and for giving the gas a temperature required by the gas before return of the gas to a web at the exterior of said perfusion roll means.

9. The combination of claim 8 and wherein a pair of foraminous web-guiding roll means respectively cooperate with said perfusion roll means for guiding a web to and from said perfusion roll means, said foraminous web-guiding roll means defining between themselves a space for receiving gas for travelling through the web engaging said webguiding roll means into the interior of the web-guiding roll means, and means communicating with the interior of each web-guiding roll means for extracting gas out of the interior thereof after the gas has passed through the web engaging each web-guiding roll means, whereby when the treating gas is steam the latter can pass into the webguiding roll means for contributing to the drying of the web.

10. The combination of claim 1 and wherein said foraminous wall portion which engages said initial portion of said web forms part of said perfusion roll means, a partition means situated in the interior of said perfusion roll means for providing in the latter a separate interior space communicating with said initial portion of the web which laps said perfusion roll means immediately subsequent to said inlet means, and said gas-removing means communicating with said separate interior space for withdrawing from the latter treating gas with entrained air flushed out of the web into said separate space, the remainder of the interior of said perfusion roll means communicating with said gas-circulating means to deliver to the latter a gas received in said remainder of the interior of said perfusion roll means after passing through the web lapping said perfusion roll means.

11. The combination of claim 1 and wherein said gas-circulating means returns the treating gas back to said enclosure means for initially entering into the latter at the region of said exit region thereof.

* * * * *